US005456630A

United States Patent [19]

Kaiser et al.

[11] Patent Number: 5,456,630

[45] Date of Patent: Oct. 10, 1995

[54] CLEANING AND DRESSING TOOL FOR BUFFING PADS

[75] Inventors: Richard A. Kaiser, Hartland; Scott S. McLain, Wind Lake, both of Wis.

[73] Assignee: Lake Country Manufacturing, Inc., Hartland, Wis.

[21] Appl. No.: 252,917

[22] Filed: Jun. 2, 1994

[51] Int. Cl.[6] ..... B24B 53/00; B24B 53/14

[52] U.S. Cl. ..... 451/444; 451/443; 451/461; 125/37; 7/170

[58] Field of Search ..... 51/181 R, 170 PT, 51/262 A, 262 T; 125/36, 37, 38, 11.03, 170; 7/170; 451/461, 358, 444, 443

[56] References Cited

U.S. PATENT DOCUMENTS

| | | | |
|---|---|---|---|
| 1,348,323 | 8/1920 | Ross | 125/37 |
| 1,427,573 | 8/1922 | Birgbauer | 125/37 |
| 2,469,871 | 5/1949 | Eaton | 125/37 |
| 2,677,362 | 5/1954 | Back | 125/37 |
| 2,926,654 | 3/1960 | Johnston | 125/37 |
| 3,094,731 | 6/1963 | Owen . | |
| 4,843,768 | 7/1989 | Stanfield | 51/206 R |
| 4,959,928 | 10/1990 | Hartwig, Sr. | 51/262 A |
| 5,123,139 | 6/1992 | Leppert et al. | 15/230.17 |

*Primary Examiner*—Robert A. Rose

*Attorney, Agent, or Firm*—Andrus, Sceales, Starke & Sawall

[57] ABSTRACT

A hand-held cleaning and dressing tool for foam buffing pads includes a series of toothed cleaning wheels mounted for independent rotation on a common shaft attached to the end of a pistol grip handle. The cleaning wheels are shrouded to help capture caked material picked up from the surface of the rotating pad. The tool also includes an abrasive dressing surface to reshape the buffing pad as a result of wear. Both the cleaning and dressing tools are operated by holding the same in operative contact with the rotatably driven pad.

4 Claims, 1 Drawing Sheet

CLEANING AND DRESSING TOOL FOR BUFFING PADS

BACKGROUND OF THE INVENTION

The present invention pertains to a tool for cleaning rotary power driven foam buffing pads and, more particularly, to a hand-held tool which may be held against the driven pad to remove caked materials or to abrasively dress the pad edges.

Pads made from reticulated foams such as flexible polyurethane, have become very popular for use in the auto finishing industry. These pads are formed in a circular or cylindrical shape and mounted for power driven rotation. When used for buffing, waxing, or polishing, oxidized paint, and other soils build up on the surface of the pad, typically as a hard cake-like layer. In addition, the original rounded or radiused edge of the circular pad may become worn and flattened. However, if the pad surface can be cleaned and the edges and other portions of the pad dressed, the pads can be given substantially extended useful lives before they are worn to the point of discarding.

Removing the pad from the drive unit and dressing the same by hand is tedious and difficult. It is preferable, therefore, to have a tool by which the pad can be cleaned and dressed while operatively mounted and being rotatably driven. However, any hand tool which is brought into contact with the rotating pad for cleaning or dressing should be constructed so it does not cause excessive tearing of the foam, leave excessive discoloration marks on the pad, or expose the user to any unnecessary risks from flying debris.

SUMMARY OF THE INVENTION

In accordance with the present invention, a hand held cleaning and dressing tool includes a handle which is preferably in the form of a pistol grip and a tool supporting end attached to and extending from one end of the handle. Preferably, the tool supporting end is formed integrally with the grip and extends angularly away from the grip in pistol-like fashion. A plurality of toothed cleaning wheels are mounted for independent rotation on a common shaft which is attached to the tool supporting end. The shaft and a major portion of the cleaning wheels are preferably enclosed in a shroud on the supporting end of the tool to which they are attached. The cleaning wheels are preferably nonmetallic and most preferably made of plastic. An abrasive pad dressing device is also attached to the tool supporting end on the outside of the shroud. The dressing device preferably comprises a semicylindrical metal grating surface.

DETAILED DESCRIPTION OF THE PREFERRED EMBODIMENT

Figure 1:
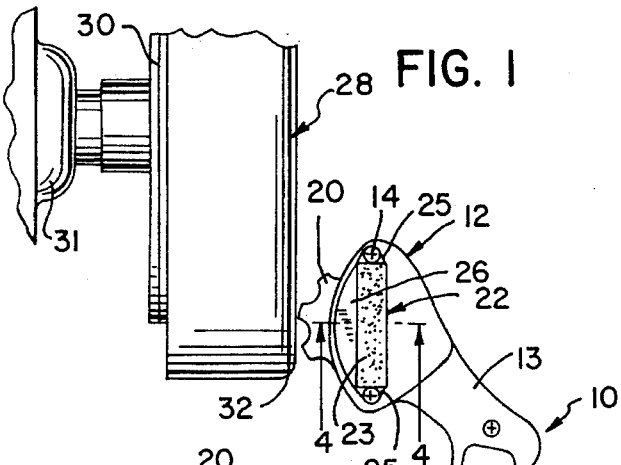
FIG. 1 shows the cleaning and dressing tool of the present invention in operative engagement with a foam buffing pad.
Figure 4:
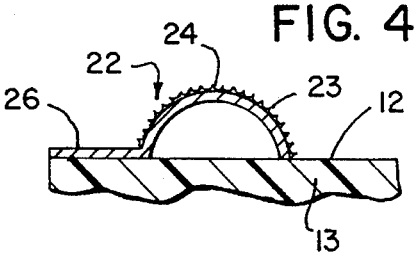
FIG. 4 is an enlarged sectional detail of the abrasive dressing device forming a part of the tool.
Figure 2:
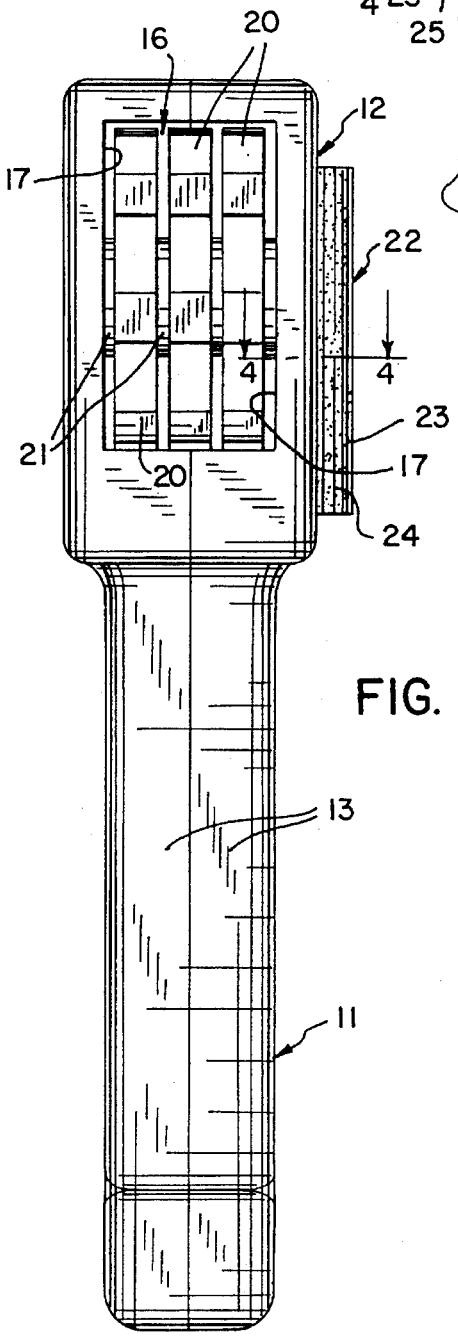
FIG. 2 is a front elevation of the cleaning and dressing tool of the present invention.
Figure 3:
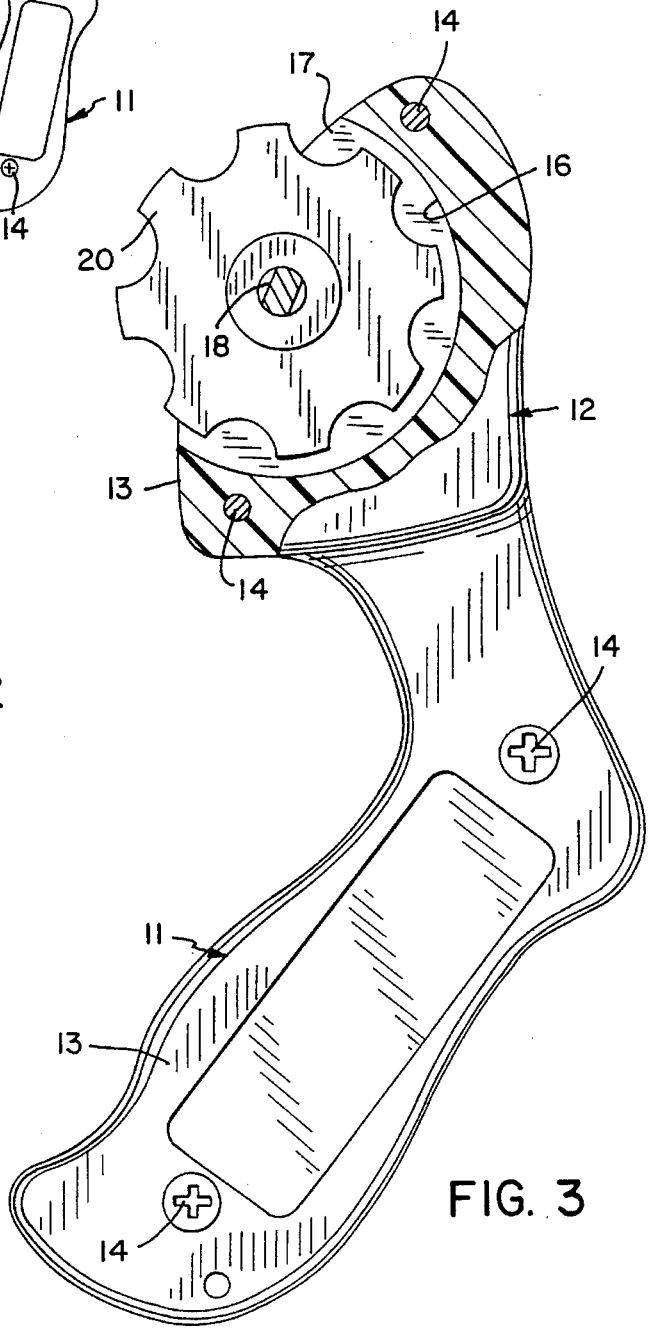
FIG. 3 is a side elevation view of the tool shown in FIG. 2.

The cleaning and dressing tool 10 of the present invention includes a pistol grip handle 11 and an integral tool supporting end 12. The handle and tool end are formed from two injection molded plastic halves 13 secured together with suitable threaded connectors 14.

The connected tool halves 13 define at the remote end of the tool a semicylindrical shroud 16 between opposite end faces 17. A shaft 18 has its opposite ends supported in openings in the end faces 17 and a series of toothed cleaning wheels are mounted for independent rotation on the shaft along the full axial length thereof between the end faces 17. Each wheel, as indicated, rotates independently on the shaft and is separated from an adjacent wheel or from an end face 17 by a suitable spacing washer 21.

On the outside surface of the portion of one tool half 13 forming the shroud 16, there is mounted an abrasive dressing tool 22. The dressing tool 22 preferably comprises a semicylindrical section 23 having an abrasive convex outer surface 24. The abrasive section 23 preferably comprises a thin stainless steel sheet having a closely spaced pattern of sharp pointed teeth formed therein in the manner of a conventional grating tool. However, the abrasive dressing tool may be made from conventional sandpaper mounted on an appropriate backing or a grinding stone. The dressing tool 22 includes a flat semicircular plate 26 extending from one edge of the semicylindrical section and shaped to substantially cover that portion of the supporting end 12 of the tool half 13 between the abrasive section 23 and the edge of the shroud 16. The flat plate 26 protects the surface of the plastic tool half from abrasion by the rotating pad which is brought into contact with the dressing tool, as will be described below. Preferably, the ends of the dressing tool 22 are provided with flat tabs 25 provided with holes for mounting. Most conveniently, the tool 22 is fixed in position by the two threaded connectors 14, on opposite sides of the shroud 16, to simultaneously secure the tabs 25 to the face of the tool half.

In use and referring to FIG. 1, the tool is held with the toothed cleaning wheels 20 in direct engagement with the surface of a buffing pad 28 mounted on a conventional pad support 30 which, in turn, is mounted on a conventional power buffer 31 or similar electric motor operated driving mechanism. The toothed cleaning wheels 20 are pressed into the surface of the pad 28 and are caused to rotate along with the driven rotation of the pad and effectively loosen caked material which is adhering to the surface of the pad. In a similar manner, the abrasive dressing tool 22 may be held against the driven pad 28 to remove material from and dress the outer surface of the pad. In particular, the dressing tool 22 may be used to restore the rounded or radiused circular peripheral edge 32 of the pad 28.

Because the major portions of the toothed cleaning wheels are recessed and enclosed within the shroud 16, caked material removed from the surface of the pad 28 and thrown by rapid rotation of the pad and the cleaning wheels will tend to be captured in the shroud 16. Thus, the shroud acts in the manner of a fender on a wheeled vehicle to block the trajectories of particles picked up and thrown by rotation of the wheels.

Various modes of carrying out the present invention are contemplated as being within the scope of the following claims particularly pointing out and distinctly claiming the subject matter which is regarded as the invention.

We claim:

1. A cleaning and dressing tool for foam buffing pads comprising:

a handle;

a tool supporting end attached to and extending from one end of the handle;

a plurality of toothed cleaning wheels mounted for independent rotation on a common shaft attached to the tool supporting end;

the portion of the tool supporting end to which the shaft is attached forming a shroud for enclosing the shaft and a major portion of the cleaning wheels; and, an abrasive covered surface attached to the tool support end directly on the outside surface of the shroud for dressing the foam buffing pad.

2. The tool as set forth in claim 1 wherein the abrasive covered surface comprises a metal grating surface.

3. The tool as set forth in claim 1 wherein the cleaning wheels are non-metallic.

4. The tool as set forth in claim 1 wherein the handle comprises a pistol grip and the tool supporting end is formed integrally with the grip and extends angularly therefrom.

* * * * *